US011130210B2

(12) United States Patent
Gallup et al.

(10) Patent No.: US 11,130,210 B2
(45) Date of Patent: Sep. 28, 2021

(54) APPARATUS FOR RELEASABLY COUPLING ABRASIVE TOOLS TO A DRIVE PLATE OF A FLOOR-TREATING MACHINE

(71) Applicants: DIAMOND PRODUCTIONS LTD., Montreal (CA); Eric Gallup, Rochester Hills, MI (US)

(72) Inventors: Eric Gallup, Rochester Hills, MI (US); Harvey Stark, Montreal (CA); Pavel Ikonomov, Laval (CA)

(73) Assignee: Diamond Productions Ltd., Montreal (CA)

( * ) Notice: Subject to any disclaimer, the term of this patent is extended or adjusted under 35 U.S.C. 154(b) by 115 days.

(21) Appl. No.: 16/659,975

(22) Filed: Oct. 22, 2019

(65) Prior Publication Data

US 2020/0122286 A1 Apr. 23, 2020

Related U.S. Application Data

(60) Provisional application No. 62/748,746, filed on Oct. 22, 2018.

(51) Int. Cl.
*B24B 7/18* (2006.01)
*B24D 7/06* (2006.01)

(52) U.S. Cl.
CPC ..... *B24B 7/186* (2013.01); *B24D 7/066* (2013.01); *B24D 2201/00* (2013.01)

(58) Field of Classification Search
CPC . B24D 7/06; B24D 7/066; B24D 7/16; B24D 2201/00; B24B 7/186; B24B 41/047; B24B 7/18
USPC ..... 451/350, 353, 360, 548
See application file for complete search history.

(56) References Cited

U.S. PATENT DOCUMENTS

| | | | | |
|---|---|---|---|---|
| 5,076,023 | A * | 12/1991 | Saguchi | B24D 7/066 451/540 |
| 7,147,548 | B1 * | 12/2006 | Mehrabi | B24B 7/186 451/323 |
| 7,192,339 | B1 * | 3/2007 | Harding | B24B 7/186 451/350 |
| 7,481,602 | B2 | 1/2009 | Lampley et al. | |
| 9,925,645 | B2 * | 3/2018 | Song | B24B 7/186 |
| 10,244,914 | B2 | 4/2019 | Tchakarov | |
| 10,449,651 | B2 | 10/2019 | Stark et al. | |
| 2009/0149117 | A1 * | 6/2009 | Barriger | B24C 5/062 451/97 |
| 2011/0300784 | A1 | 12/2011 | Tchakarov et al. | |

(Continued)

FOREIGN PATENT DOCUMENTS

| | | | |
|---|---|---|---|
| KR | 20090001823 U | * | 2/2009 |
| KR | 101553991 B1 | * | 9/2015 |
| WO | WO2019140086 | | 7/2019 |

*Primary Examiner* — Joseph J Hail
*Assistant Examiner* — Jonathan R Zaworski
(74) *Attorney, Agent, or Firm* — Thomas J. Nikolai; DeWitt LLP

(57) ABSTRACT

A drive plate attachable to a driven shaft of a floor-finishing machine has a central circular recess and a plurality of radially extending pockets having beveled side edges formed in a surface thereof. Located in the pocket is a rectangular stabilizing bar. The abrasive tool includes a plate sized and shaped to fit into the pockets when inserted from the central recess and having a groove formed therein for receiving the stabilizing bar. On the surface of the tool plate opposite the groove are abrasive members.

5 Claims, 5 Drawing Sheets

(56) References Cited

U.S. PATENT DOCUMENTS

| | | | | |
|---|---|---|---|---|
| 2013/0157548 | A1 | 6/2013 | Palushaj | |
| 2016/0136772 | A1 | 5/2016 | Littlefield et al. | |
| 2018/0345453 | A1* | 12/2018 | Stark | B24D 7/066 |

* cited by examiner

APPARATUS FOR RELEASABLY COUPLING ABRASIVE TOOLS TO A DRIVE PLATE OF A FLOOR-TREATING MACHINE

CROSS-REFERENCED TO RELATED APPLICATIONS

This application is a non-provisional application of Application No. 62/748,746, filed Oct. 22, 2018, and claims priority from that application which is also deemed incorporated by reference in its entirety in this application.

STATEMENT REGARDING FEDERALLY SPONSORED RESEARCH OR DEVELOPMENT

None

BACKGROUND OF THE INVENTION

I. Field of the Invention

This invention relates to machines for grinding and polishing concrete and terrazzo floors and more particularly to a method and apparatus for removably affixing abrasive tools to a rotary motor driven drive plate used on such machines.

II. Discussion of the Prior Art

Generally speaking, there are two types of machines in use for treating concrete and stone floors, namely, walk-behind machines and ride-on machines. Such machines include one or more motor driven rotary drive plates to which are affixed a plurality of abrasive tools. The abrasive tools comprise a plate having two opposed major surfaces. The first major surface includes a means for releasably joining it to the drive plate and the second major surface generally has a plurality of abrasive elements bonded to it. The abrasives typically comprise industrial diamond chips in a sintered metal or resin bonding material.

A variety of ways are known in the art for securing the abrasive tools to the drive plate. For example, Velcro® hook and loop fabrics have been used, as have permanent magnets and screws.

Another approach more closely related to the present invention is to provide a tapered radial pocket of a predetermined shape in the drive plate for receiving the tools' plate of a corresponding shape and taper so that the tool becomes wedged in the drive plate's pocket. The present invention provides an improvement by incorporating a stabilizing bar in the pocket that is designed to mate with a recess formed inward of the abrasive tool's first major surface which has been found to reduce movement/displacement of the abrasive tool relative to the drive plate during high speed rotation of the drive plate during use of the floor treating machine. This is especially advantageous when the machine is being used to grind an uneven surface of a concrete or stone slab.

SUMMARY OF THE INVENTION

In accordance with the present invention, a drive plate for a floor-treating machine comprises a disc adapted for attachment to a driven shaft, the drive plate having opposed major surfaces. The first of the opposed surfaces includes a central hub for attaching the drive plate to the driven shaft. The second, lower, surface includes at least one and preferably several circumferentially-spaced tapered pockets with beveled edges in which abrasive tools can be inserted and removed. Each of the pockets includes a centrally disposed, radially extending stabilizing bar projecting out from the base of the pocket. Likewise, each of the abrasive tools includes a groove or channel for mating with the bar in the tapered pocket of the drive plate.

The stabilizing bar serves to first guide an abrasive tool into its pocket. In addition, the stabilizing bars acts as a force absorbing element as the beveled side edges of the abrasive tool strike the floor as the drive plate is being rotated on its axis. Thus, beveled edge walls on the abrasive tools are not prematurely worn down to the point where the tools can escape from the drive plate pockets and do damage to the floor being treated or to the floor treating machine itself. It is also found that by placing the stabilizing bars on the drive plate and the channel on the abrasive tools it reduces the weight of the tools which serves to reduce stress on the motor.

BRIEF DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
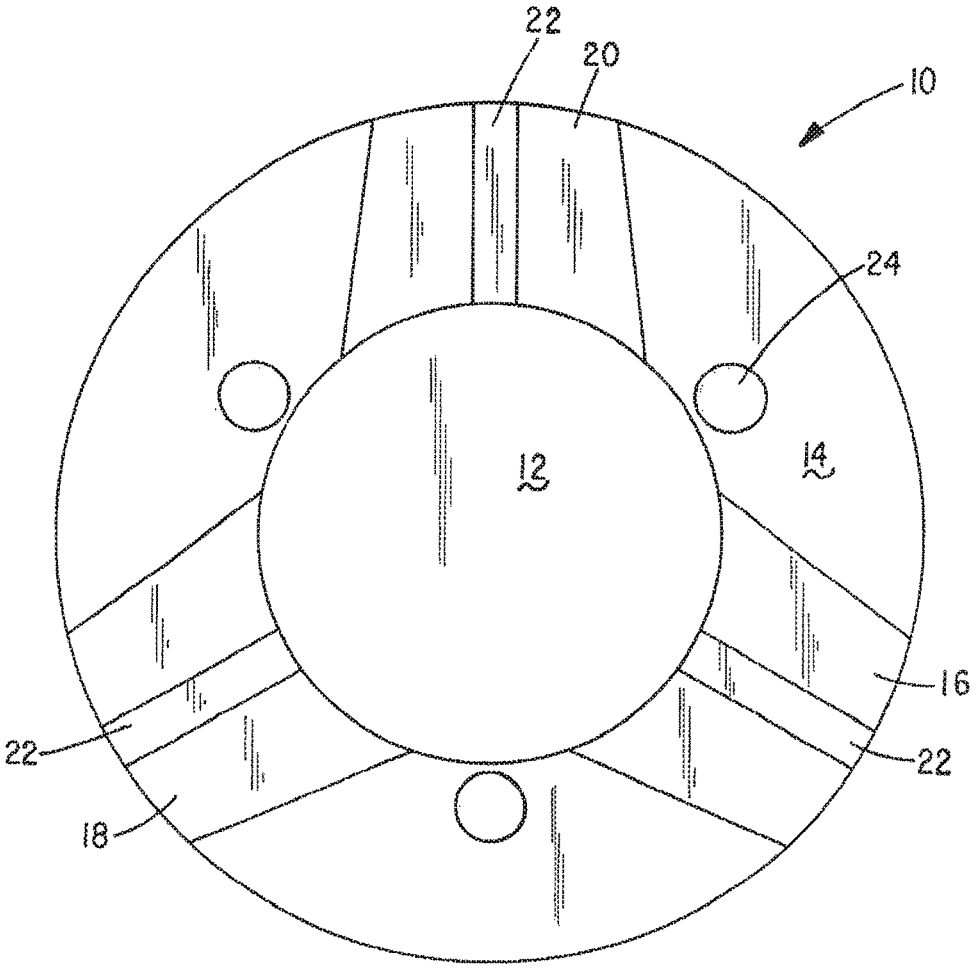
FIG. 1 is a plan view of a split wedge drive plate of the present invention.
Figure 2:
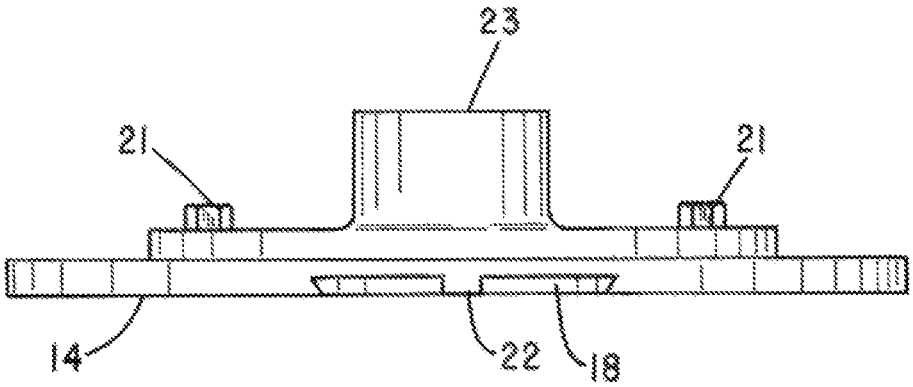
FIG. 2 is a side elevation view thereof.

The description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top", and "bottom", as well as derivatives thereof (e.g., "horizontally", "downwardly", "upwardly", etc.), should be construed to refer to the orientation as then described or as shown in the drawings under discussion. These relative terms are for the convenience of description and do not require that the apparatus be constructed or operated in a particular orientation. Terms, such as "connected", "connecting", "attached", "attaching", "join", and "joining", are used interchangeably and refer to one structure or surface being secured to another structure or surface or integrally fabricated in one piece, unless expressly described otherwise. As used herein, the term "floor treating machine" is meant to include floor grinding, floor polishing, floor burnishing, floor scrubbing and swing machines.

In FIG. 1 the drive plate is indicated generally by numeral 10 as is seen to comprise a metal plate preferably of steel, that is circular in form. It is of a predetermined thickness dimension and includes a central, concentric recessed portion 12 on its bottom surface 14 along with radially extending tapered pockets 16, 18 and 20 extending radially from the central recess 12 to the perimeter of the circular plate 10.

The pockets 16, 18 and 20 are linearly tapered, being more narrow at the perimeter of the drive plate than at its intersection with the central circular recess 12. Centrally located between the side edge of the pockets 16, 18 and 20 and projecting upwardly therefrom are stabilizing bars 22.

The drive plate 10 is adapted to be affixed to a rotary drive member of the machine by bolts 21 passing through a hub 23 into threaded apertures 24 that extend through the thickness dimension of the plate 10. The hub is keyed to a driven shaft of the machine.

Figure 4:
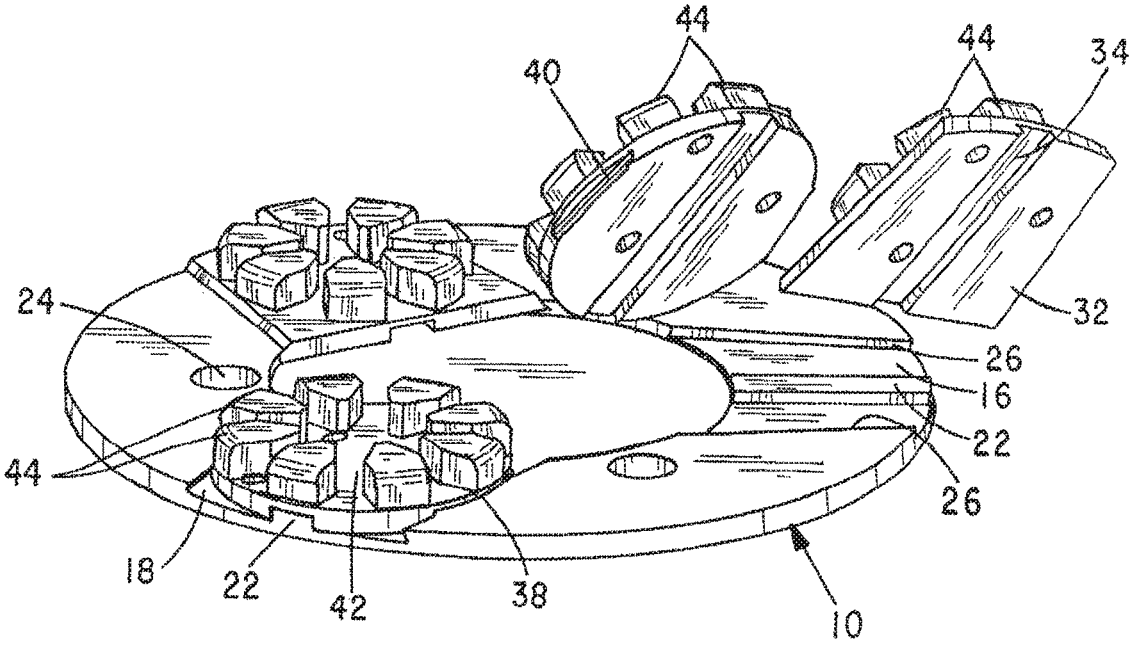
FIG. 4 is a perspective view of the split wedge drive plate with split wedge tools mounted thereon.

Referring momentarily to FIG. 4, it can be seen that the radially extending edges 26 of the pockets 16, 18, and 20 are beveled while the opposed edges of the stabilizing bars 22 are perpendicular to the surfaces of their respective pockets.

Figure 3A:
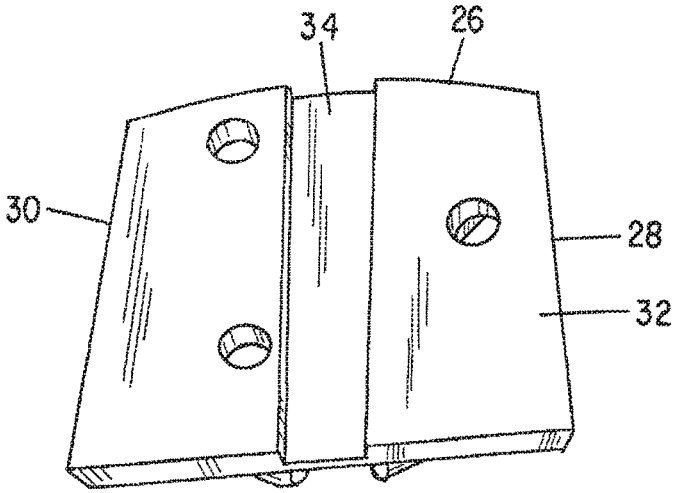
FIG. 3A is a perspective view of a split wedge polygonal tool.
Figure 3B:
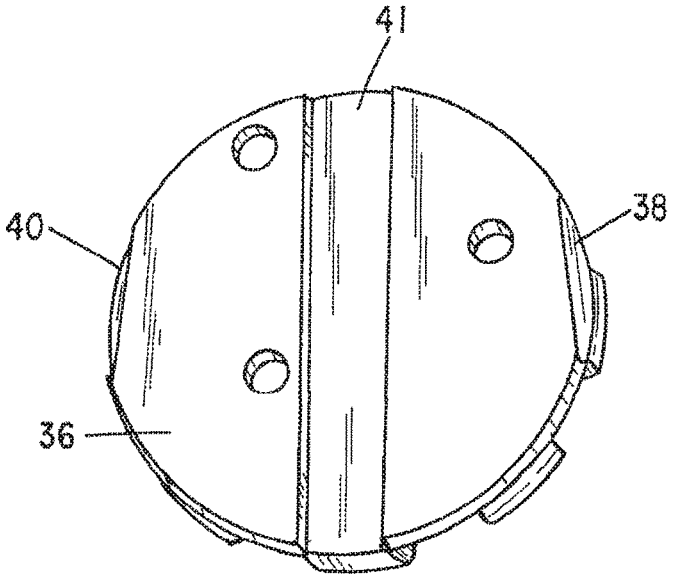
FIG. 3B is a plan view of a split wedge circular tool.

FIGS. 3A and 3B illustrate two different designs for abrasive tools that can be used with the drive plate 10 of FIG. 1. In FIG. 3A, the tool is somewhat trapezoidal in its plan view except that its outer edge 26 is rounded to conform to the outer perimeter of the drive plate 10. The side edges 28 and 30 are tapered both in the radial direction and in a thickness direction to conform with the shape of the pockets 16, 18 and 20. Formed inwardly from an upper surface 32 in the abrasive tool of FIG. 3A is a groove or channel 34 that is designed to provide a slight clearance fit with respect to the stabilizing bars 22. Thus, one is able to position the tool of FIG. 3A within the central recess 12 of the plate 10 and then slide the tool radially outward in its pocket to the point where the curved front edge 26 of the tool is aligned with the circumferential edge of the drive plate 10.

In FIG. 3B, the plate 36 of the abrasive tool shown there is generally circular. However, its edges are machined as at 38 and 40 to conform to the taper of the pockets 16, 18 and 20 of the drive plate 10. It also has a groove or channel 40 dimensioned to provide a predetermined clearance fit about the stabilizing bars 22 of the drive plate.

Figure 5:
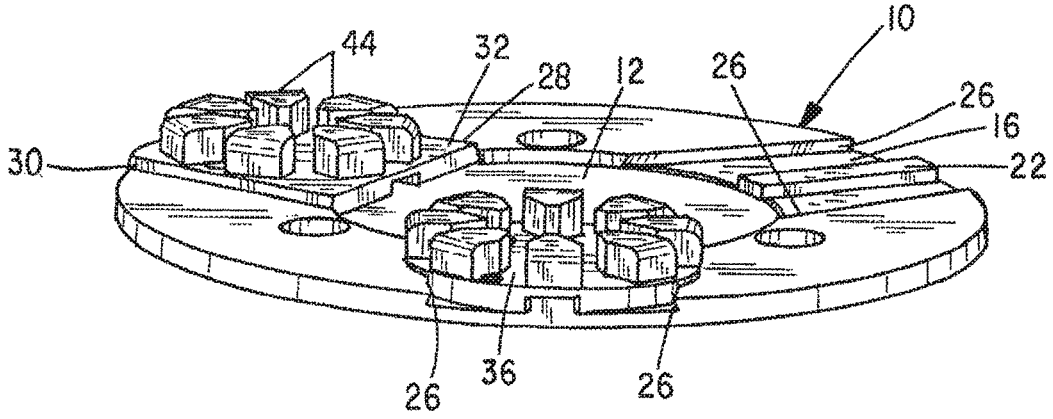
FIG. 5 is a further view like that of FIG. 3.

As seen in FIGS. 4 and 5, bonded to the bottom surface 42 of the tool plate are a plurality of abrasive elements that typically comprise industrial diamond chips in a sintered metal or resin bonding material. Also visible in the views of FIGS. 4 and 5 are the sloped edges 28 and 30 of the abrasive tools that are made to interact with the beveled edges 26 on the drive plate 10 to secure the abrasive tools in place on the drive plate 10. When it is recognized that, in use, the drive plates 10 are made to spin at a somewhat high angular velocity, centrifugal force acts on the tools to more firmly wedge them into their respective tapered and beveled pockets. However, when the machine is stopped and it is desired to replace worn abrasive elements with a new tool or when it is desired to change the grit of the abrasives being used, a mere tap by a hammer on the exposed outer edge of the tools moves them back into the central recess 12 of the drive plate allowing them to be readily removed for replacement.

Although the invention has been described in connection with specific embodiments of the same, it will be understood that it is capable of obvious variations without departing from its scope.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. Apparatus for releasably attaching abrasive tools to a drive plate of floor-treating machines comprising:

(a) a circular drive plate having first and second major surfaces with a centrally disposed hub attached to and projecting outward from a first major surface and adapted to be joined to a driven shaft of a floor-treating machine, and the circular drive plate having a central circular recess having a plurality of radially extending pockets formed into the second major surface thereof where the radially extending pockets have inwardly beveled edges extending from the central recess to a peripheral edge of the circular drive plate and where the side edges are also tapered radially, being spaced apart a greater distance at the central recess than at the peripheral edge, said pockets each having a radially extending stabilizing bar of rectangular cross section extending outward from a floor surface of the pockets; and (b) a plurality of abrasive tools, each comprising a tool plate having first and second major surfaces and with beveled edges, complimentary to the beveled edges of the pockets, the tool plate having abrasive members affixed to its first major surface and a rectangular radially extending groove formed inward of the second major surface located such that the tool plate can be inserted from the circular recess in the drive plate into the pocket with the stabilizer bar contained within the rectangular groove with a clearance fit.

2. The apparatus of claim 1 wherein the tool plate has a trapezoidal shape in a plan view thereof.

3. The apparatus of claim 1 wherein the tool plate is of a circular shape in a plan view thereof.

4. The apparatus of claim 1 wherein the abrasive members comprise one of a metal-bonded diamond member and a resin-bonded diamond member.

5. The apparatus of claim 2 wherein an outer perimeter of the tool plate has a curvature matching that of the circular drive plate.

* * * * *